US005325821A

United States Patent [19]

Glöersen

[11] Patent Number: 5,325,821

[45] Date of Patent: Jul. 5, 1994

[54] METHOD AND DEVICE IN CLOSED HEATING PLANTS

[76] Inventor: Stig Glöersen, Luotsikatu 4 B 12, SF-00160 Helsinki, Finland

[21] Appl. No.: 867,714

[22] PCT Filed: Jan. 8, 1991

[86] PCT No.: PCT/SE91/00012

§ 371 Date: Sep. 5, 1992

§ 102(e) Date: Sep. 5, 1992

[87] PCT Pub. No.: WO91/10868

PCT Pub. Date: Jul. 25, 1991

[30] Foreign Application Priority Data

Jan. 8, 1990 [SE] Sweden ..... 9000007

[51] Int. Cl.[5] ..... F22B 33/00

[52] U.S. Cl. ..... 122/1 R; 62/238.6; 165/2; 237/2 B

[58] Field of Search ..... 122/1 R; 237/2 B; 165/2; 62/238.6

[56] References Cited

U.S. PATENT DOCUMENTS 4,178,988 12/1979 Cann et al. ..... 165/2

4,687,133 8/1987 Karlstedt ..... 237/2 B

*Primary Examiner*—Edward G. Favors

*Attorney, Agent, or Firm*—Cohn, Powell & Hind

[57] ABSTRACT

A method of utilizing the high energy values of fossile fuels in central heating boiler systems. The boiler system comprises a processor which includes an air heat pump (5) which functions to cool the system flue gases by condensation. A first fan (10) generates a first circulation ($C_1$) of boiler room air, via the air heat pump (5), this circulation of air also passing through a heat exchanger (4) where heat exchange takes place with the flue gases. A second air circulation ($C_2$) is generated with the aid of a flue-gas fan (7) which removes flue gases from the boiler by suction, thereby generating a subpressure in the boiler room so that fresh air will be drawn in from the ambient surroundings, this air passing through the heat exchanger (4). A lower pressure is maintained on that side of the heat exchanger (4) on which the air/flue gas mixture ($C_2$) flows into the heat exchanger, whereas a higher pressure is maintained on the other side of the heat exchanger (4) on which the air/flue gas mixture ($C_2$) flows into the heat exchanger (4) on which the cooling boiler-room air circulates ($C_1$). This will ensure that flue gases will always flow out to the free atmosphere, via the heat exchanger (4). The exhaust air/flue gas mixture is caused to pass a cooling device (21) and thereby pre-cooled prior to passing through the heat exchanger in said second circulation.

15 Claims, 3 Drawing Sheets

METHOD AND DEVICE IN CLOSED HEATING PLANTS

The present invention relates to a method for utilizing effectively the high energy values of fossile fuels in closed boiler systems, with the aid of a processor which includes an air heat pump and a heat exchanger in which air is cooled for cooling the flue gases generated in the boiler system, said heat exchange taking place between two circulating air flows through the heat exchanger. The invention also relates to an arrangement for carrying out the method.

Such arrangements are known from the Swedish Patent Specifications 7909528 and 8306259-6, and also from Swedish Patent Application 8300609-8.

The main object of the invention is to improve the operation of arrangements of this kind, particularly with regard to ensuring that the flue gases will always exit from the boiler system, even in the event of a heat-exchanger malfunction or some similar malfunction.

A further object of the invention is to improve the boiler system so that the energy values of the fuel used can be utilized effectively.

These and other objects of the invention are achieved by means of the inventive method and arrangement having the characteristic features set forth in the following Claims.

Figure 1:
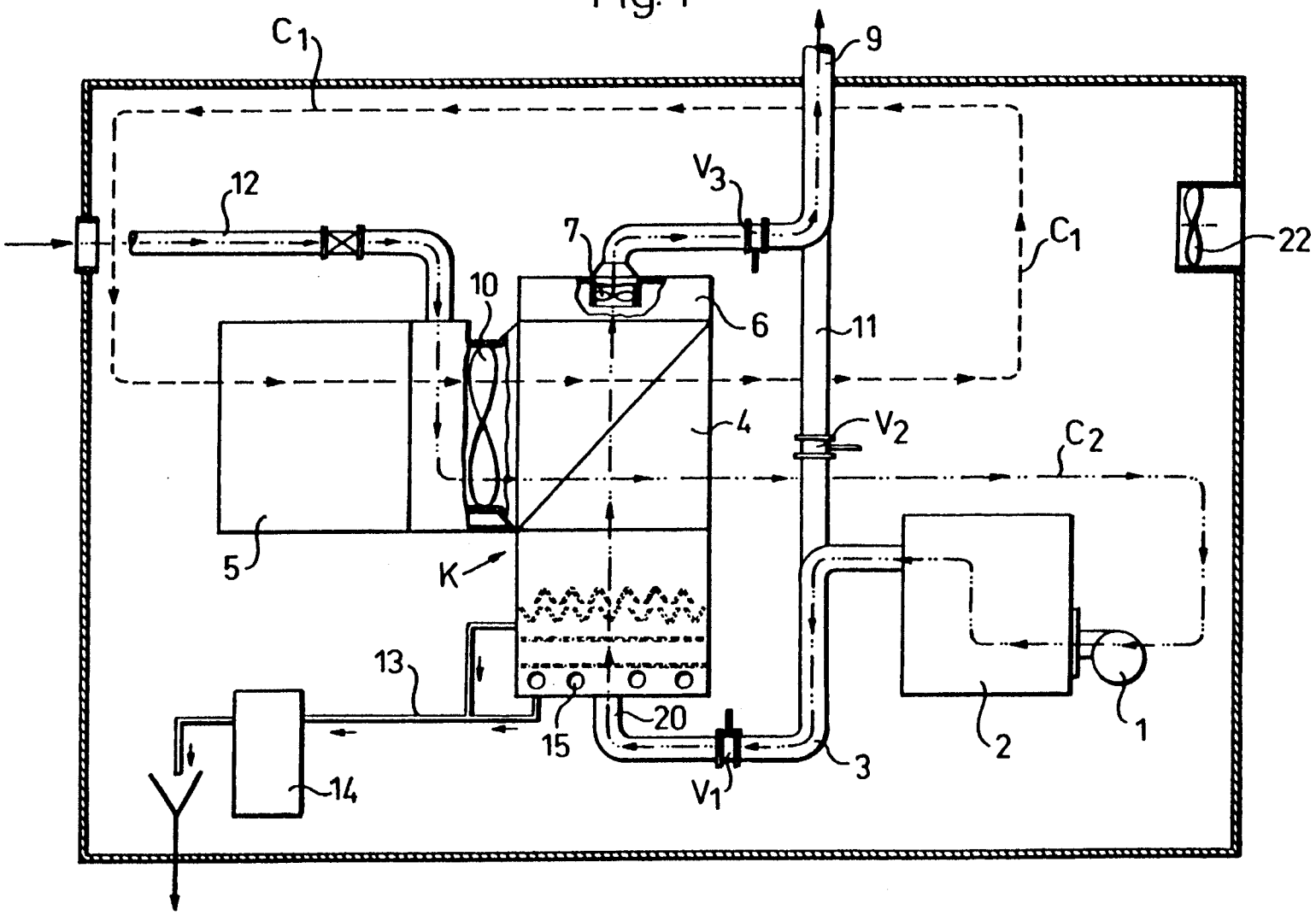
Figure 2:
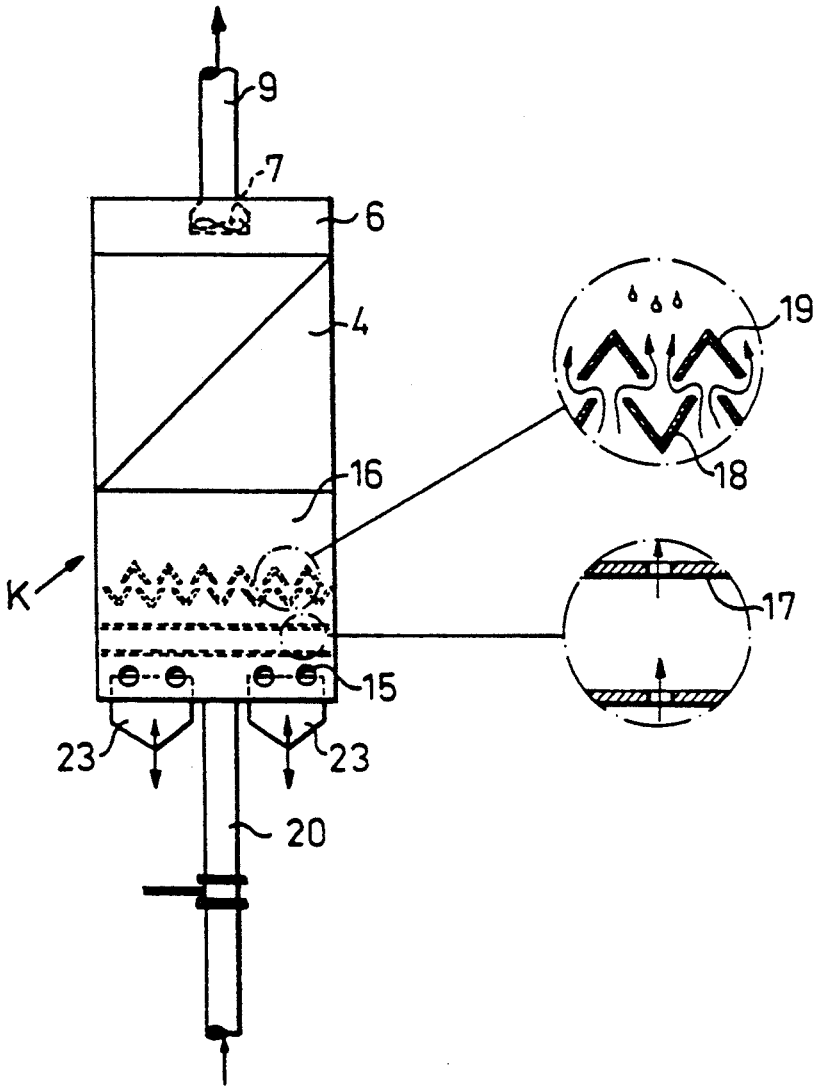
Figure 3:
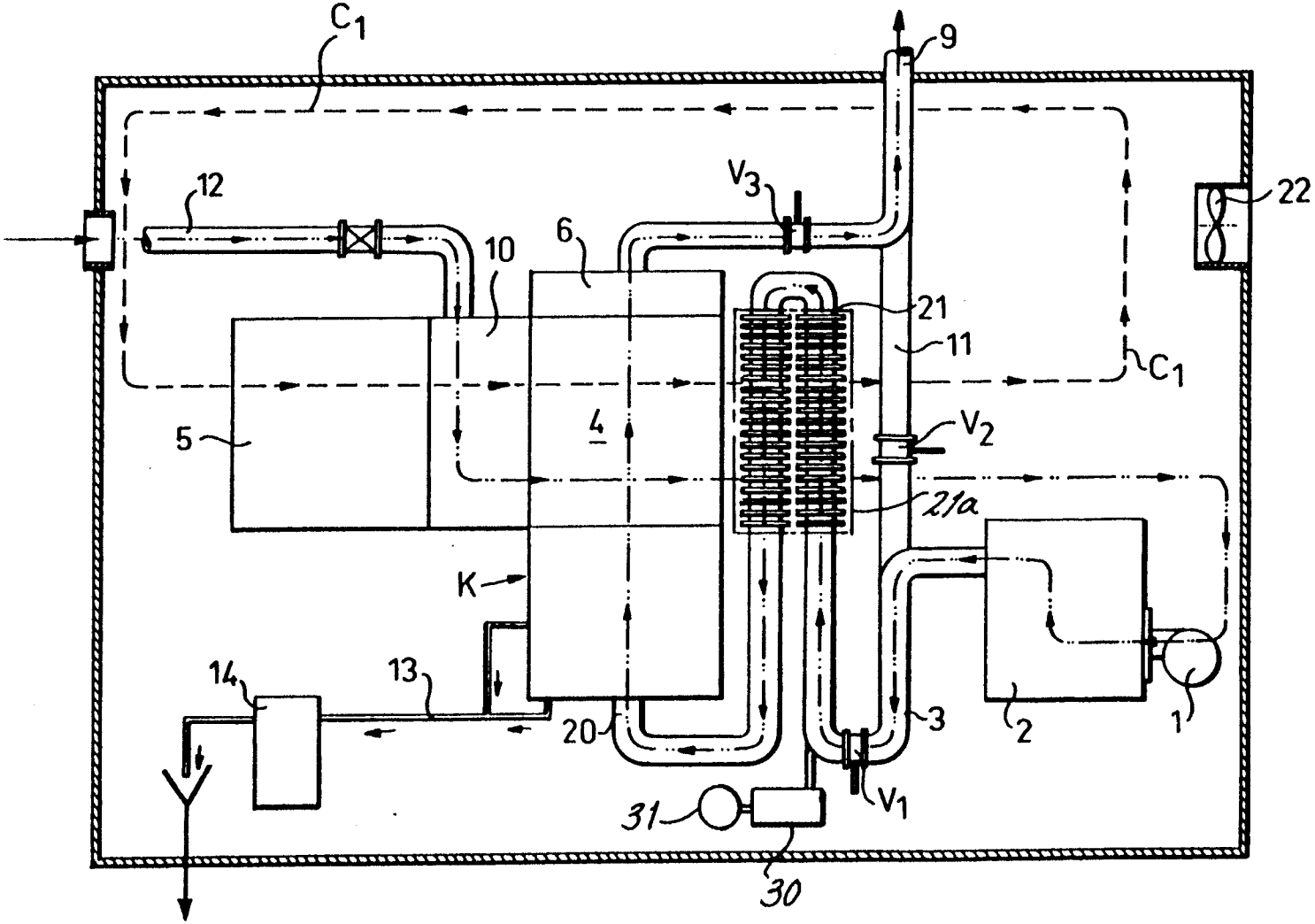

The invention will now be described in more detail with reference to the accompanying drawings, in which FIG. 1 is a schematic, cross-sectional view of the inventive boiler system;

FIG. 2 is a cross-sectional view of a condensation trap or collector included in said system; and FIG. 3 is a sectional view, similar to the view of FIG. 1, of a modified embodiment of the system.

The system illustrated in FIG. 1 includes an oil or gas burner 1 mounted in a boiler 2. The boiler 2 is connected to a condensation trap K by means of a channel 3, as described in more detail herebelow, said condensation trap K being connected upstream of a heat exchanger 4. Connected to the channel 3 is a shunt channel 11 which extends to an exhaust pipe or smoke stack 9 through which exhaust air or flue gas/air mixture exits from the system. The system includes a shut-off valve $V_1$, $V_2$ and $V_3$ by means of which the flue gases or flue gas/air mixture can be selectively passed through the channel 3 to the condensation trap K, or through the channel 11 to the flue stack 9, this latter case being applicable, for instance, when carrying out maintenance or repair on the processor components, such as on the heat-pump or heat exchanger.

Arranged above the heat exchanger 4 is a suction chamber 6, which is equipped with a fan 7 connected to a suction pipe 9. The system also includes an air heat pump 5 which is spaced from the heat exchanger 4. Arranged in this space is a fan 10 to which a fresh-air intake channel 12 is connected. A condensation line 13 extends from the condensation trap K to a neutralising vessel 14. The entire system is incorporated in a closed boiler room, from which only the air inlet, air outlet and flue stack will normally communicate with the ambient atmosphere.

The system illustrated in FIG. 1 operates in the following manner: As shown in broken lines, the system includes a first circulation path $C_1$ around which boiler-room air circulates, said air being drawn into the heat pump 5 by the fan 10, which forces the air into the heat exchanger, optionally through the admixture of fresh air, as indicated by the double-dot-dash line in the pipe 12, when the burner 1 is in operation, as described below. The admixture of fresh air has thus two functions; because hydrogen gas is generated during the combustion process, the amount of condensation formed can be increased threefold by introducing fresh air and by cooling of the flue gases to the low temperature; and because the amount of condensation is increased, the extraction of sulphur contaminants from the flue gases is improved, i.e. the condensation will be less corrosive and therefore cause less corrosion damage to equipment. The air passes from the heat exchanger 4 back to the boiler room. When the boiler 1 is functioning, a subpressure is generated in the boiler room, therewith causing fresh air to be drawn into the boiler room and to deliver oxygen to the burner. When the burner is not functioning, the first air circulation $C_1$ operates without the inclusion of fresh air. Air is then circulated in the second circulation path $C_2$ by the exhaust suction fan 7, this air primarily entering the heat exchanger 4, through the burner 1 and via the channel 3 and the condensation trap K, and secondarily as mixing air, since that part of the air which passes the burner is very small. This mixing air enters beneath the condensation trap, through holes 15 provided therein. The air which is drawn out by suction, via the circuit $C_2$, will enter via the fan 10 located between the heat-pump 5 and the heat exchanger 4. When the fan 7 is started, a subpressure is generated in the boiler room, causing fresh air to flow-in through the pipe or conduit 12. In this way, the flue gases are subjected to a last cooling stage in the heat exchanger 4, prior to being blown to atmosphere by the fan 7.

Because the cross-flow heat exchanger 4 is positioned downstream of the fan 10 by means of which the boiler-room air is circulated, the circulation $C_1$ of boiler-room air will create an overpressure on the cooling side of the heat exchanger, whereas a subpressure is created by means of the exhaust-air fan 7 on the other side of said heat exchanger, said fan drawing the exhaust air, or flue gas/air mixture, through the other side of the heat exchanger by suction. This means that the oil burner can be arranged so as not to start until a predetermined subpressure has been generated in the heat exchanger. Because the fan 10 maintains an overpressure on the cooling side of the heat exchanger, it is ensured, in accordance with the invention, that the flue gases will always exit to free atmosphere, for example in the event of a defective heat exchanger.

When carrying out maintenance on the processor, for example when washing the heat exchanger 4 or servicing the heat pump, the shut-off valves $V_1$, $V_2$ and $V_3$ are connected so that the flue gases will pass directly to atmosphere through the flue stack 9, via the conduit 11. The system is then operated as a conventional boiler system, in the absence of a processor, to supply the building with energy.

The condensation trap K, illustrated in FIG. 2, includes a housing 16 in which holes 15 are disposed for the purpose of admixing air with the flue gases upstream of the heat exchanger, as described above, and also a perforated plate 17 through which air and flue gases pass upwardly in the trap K. Arranged above the plate 17 are collectors 18 which capture or collect condensation arriving from above and conduct this condensation to the outlet conduit 13. In order to prevent condensation droplets from falling into the lower part of the housing 16, baffles 19 are mounted above the respective interspace between mutually adjacent collectors 18 and in spaced relationship with interspaces above said collectors, whereby the air and the flue gases upstream of the heat exchanger are able to pass between the collectors and said baffles upwardly in the condensation trap K, as illustrated by the arrows. Mounted below the condensation trap K is a pipe connector 20 which passes the flue gases from the channel 3 to the trap K, from where they pass to the heat exchanger 4. The air mixture passing through the holes 15 can be adjusted with the aid of a damper valve 23, which can be moved upwards and downwards in the directions of the arrows so as to expose a larger or smaller area of the holes 15.

For the sake of simplicity, the system will now be described for that case when the burner 1 is in operation, i.e. when the flue gases generated in the boiler 2 are passed to the condensation trap K, in which boiler room air is admixed via the turbulators 17 (the perforated plates) and condensation drains from the upper baffles 19 shown in FIG. 2. The flue gases are cooled in the heat exchanger 4, through which boiler room air, flows via the heat pump 5, together with fresh air taken from the outer surroundings. The temperature of the flue gas is reduced in said system from 170° C. to about 5°-10° C.

In the case of the system illustrated in FIG. 3, the flue gases, without being admixed with boiler room air, are cooled through their passage through the holes 15, illustrated in FIGS. 1 and 2, in that said gases are caused to pass a cooling device 21, in the illustrated case a flanged, tubular cooling device, in which the flue gases are cooled by the air circulating from the heat exchanger 4 and passing over the flanges or fins on the cooling device 21. As will be understood, cooling can also be achieved with water, as by a water cooling device 21*a*, which will also increase the extent to which sulphur contaminants are extracted and thereby further reduce the risk of corrosion.

In the summer months, the boiler room is ventilated by means of a fan 22 mounted in the wall of the boiler room, so that warm, outside air is able to flow into the boiler room. The heat-pump may be dimensioned so that said pump is alone able to heat the warm water required during the summer months. The burner 1 is therewith only operated in the event of specific heat requirement peaks during summertime.

When practicing the invention, surfaces are dirtied to a much lesser extent by the flue gases than when practising conventional techniques. In other words, 1) because a reduction in oil consumption of 50-70% is achieved, this percentage depending on the building concerned, there is obtained a corresponding reduction of 50-70% in the emission of sulphur contaminants and nitrogen contaminants to the surrounding air, and 2) when condensing the flue gases the remaining energy value of the oil is utilized, while 60-80% of the sulphur emission of the flue gases is condensed and delivered to the neutralizing vessel 14 in the form of condensate. Prior to being neutralized, the condensate has a pH of about 2.5-3.5 and after being neutralized, a pH of about 6-8. Thus, when burning 1 liter of oil, there is obtained about 1 liter of acid condensate of pH 2.5-3.5.

The illustrated and described system has a total energy saving of about 50%. If the maximum power of the system is, for instance, 100 kW and the heat-pump is operated at about 5±2 kW, the energy delivered by the heat-pump will be about 9-21 kW. The heat-pump has an energy saving factor of 3, throughout the whole year. The annual average efficiency lies between 130 and 140%, depending on the geographic latitude on which the system is installed, calculated on the lower energy value. The annual average efficiency can also be expressed as the energy saving factor of the system, when all oil and electricity is counted as power applied to the system. This energy saving factor is thus 1.3-1.4 over the period of one year, depending on the geographical latitude on which the system is installed.

The heat pump works continuously over substantially the whole of the year, whereas the burner 1 works discontinuously. The heat pump 5 may, for example, be driven by a diesel motor (not shown) or the system as a whole may be powered by electricity generated by a separate diesel generator (30, 31), the exhaust gases of which are cooled and condensed together with the boiler flue gases. When the system is self-supporting and run on a diesel generator, it is not necessary to supply energy, such as electrical energy, to the system from an external source.

It will be understood that the aforedescribed and illustrated embodiment of the invention merely exemplifies a manner in which the invention can be realized, and that the described embodiment can be modified within the scope of the following claims.

I claim:

1. A method of utilizing the high energy values of fossile fuels in closed boiler systems with the aid of a processor which includes a heat pump and a heat-exchanger, in which heat exchange is effected between two air flows circulating through the heat exchanger by generating a first circulation of boiler-room air, via the heat pump and the heat exchanger, and by generating a second circulation through the heat exchanger by extracting exhaust air or flue gases, or a mixture thereof, by suction, said second circulation generating a subpressure in the boiler room such as to cause external fresh air to flow in through the heat exchanger, characterized in that the exhaust air or the flue gases, or said mixture thereof, is or are caused to pass a cooling device and thereby pre-cooled prior to passing through the heat exchanger in said second circulation.

2. A method according to claim 1, characterized in that the gases are pre-cooled by circulated boiler room air.

3. A method according to claim 1, characterized in that the gases are pre-cooled by water.

4. A method according to claim 1, characterized by drawing at least a part of the air in said first circulation through the heat-pump prior to forcing said air through the heat exchanger.

5. A method according to claim 1, characterized by rendering the boiler-system burner inactive until a subpressure has been generated in the second circulation through the heat exchanger.

6. A method according to claim 1, characterized in that fresh air is admixed with the first circulation prior to passage through the heat exchanger.

7. An arrangement claim 7, for utilizing the high energy values of fossile fuels in a closed boiler system, said arrangement comprising a processor which includes a heat pump (5) and a heat exchanger (4), and fan means (10) provided for forcing boiler room air through one side of the heat exchanger (4) and a suction chamber (6) which functions to draw exhaust air or flue gases, or a mixture thereof, through the other side of the heat exchanger (4) by suction, characterized of a cooling device (21) mounted between the boiler (2) of said boiler system and the heat exchanger (4), said cooling device being intended to pre-cool the exhaust air or the flue gases, or said mixture thereof, prior to its/their entry into the heat exchanger (4).

8. An arrangement according to claim 7, characterized in that the cooling in the cooling device (21*a*) is achieved with water.

9. An arrangement according to claim 7, characterized in that the fan means (10) draws boiler room air through the heat pump (5) by suction and to forces said air through the heat exchanger (4).

10. An arrangement according to claim 7, characterized by means (12) for mixing fresh air with the boiler room air prior to said air being forced into the heat exchanger (4) by the fan means (10).

11. An arrangement according to claim 7, characterized in that a condensation trap (K) is arranged between the boiler (2) of the boiler system and said one side of the heat exchanger (4), wherein exhaust air or flue gases, or a mixture thereof, passes/pass to the heat exchanger (4) through said trap.

12. An arrangement according to claim 7, characterized in that the boiler system is powered with electricity generated by a separate or free-standing generator (31) driven by an internal combustion engine (30), wherein the engine exhaust gases are cooled and condensed either separately or together with the boiler flue gases.

13. An arrangement according to claim 7, characterized of a fan (22) mounted in a wall of the boiler room in order to ventilate the boiler room by outside air.

14. A method according to claim 1, characterized in that the first circulation of boiler room air is generated through the action of overpressure on that side of the heat exchanger on which the cooling boiler-room air is circulated.

15. An arrangement according to claim 7, characterized in that the fan means forces boiler room air through one side of the heat exchanger at overpressure.

* * * * *

UNITED STATES PATENT AND TRADEMARK OFFICE

CERTIFICATE OF CORRECTION

PATENT NO. : 5,325,821

DATED : July 5, 1994

INVENTOR(S) : Stig Glöersen

It is certified that error appears in the above-identified patent and that said Letters Patent is hereby corrected as shown below:

Column 4, line 60, delete "claim 7,"

Column 5, line 11, delete "to"

Signed and Sealed this

Eleventh Day of October, 1994

*Attest:*

Bruce Lehman

BRUCE LEHMAN

*Attesting Officer*

*Commissioner of Patents and Trademarks*